United States Patent [19]

Kwiatek

[11] Patent Number: 4,846,671

[45] Date of Patent: Jul. 11, 1989

[54] INTEGRAL SPARK IGNITED GAS BURNER ASSEMBLY

[75] Inventor: David J. Kwiatek, Berwyn, Ill.

[73] Assignee: Harper-Wyman Company, Lisle, Ill.

[21] Appl. No.: 280,664

[22] Filed: Dec. 6, 1988

Related U.S. Application Data

[63] Continuation-in-part of Ser. No. 166,042, Mar. 9, 1988, Pat. No. 4,810,188.

[51] Int. Cl.[4] ..... F23Q 3/00

[52] U.S. Cl. ..... 431/266; 431/264; 126/39 E

[58] Field of Search ..... 431/264, 266; 126/39 E, 126/39 R, 39 BA, 39 H

[56] References Cited

U.S. PATENT DOCUMENTS

| | | | |
|---|---|---|---|
| 1,968,978 | 8/1934 | White | 431/266 |
| 2,960,980 | 11/1960 | Williams et al. | 126/39 J |
| 4,518,346 | 5/1985 | Pistien | 431/266 |
| 4,626,196 | 12/1986 | Stohrer | 431/264 |

FOREIGN PATENT DOCUMENTS

| | | | |
|---|---|---|---|
| 2408096 | 7/1979 | France | 431/264 |
| 7808145 | 2/1980 | Netherlands | 431/264 |
| 1543618 | 4/1979 | United Kingdom | 431/266 |

*Primary Examiner*—Margaret A. Focarino
*Attorney, Agent, or Firm*—Mason, Kolehmainen, Rathburn & Wyss

[57] ABSTRACT

A gas burner assembly includes a detachable burner cap assembly having an electrically conductive burner cap body with a plurality of burner ports and an ignition port formed in a sidewall of the burner cap body. The burner cap body is connected to an electrical ground potential. An electrically insulative support member is mounted in the ignition port and defines an electrode receiving aperture. The electrically insulative support member cooperates with the ignition port to define an ignition gas pathway. A spark electrode extending through the support member aperture includes a portion extending though the ignition port and completely surrounded by the insulative support member. The spark electrode is selectively connected to an high voltage potential for providing ignition sparks between the electrode and the burner body through the ignition gas pathway. A stationary base assembly is adapted for detachable mating engagement with the burner cap assembly. The stationary base assembly includes a gas mixing member defining an aperture for receiving primary air and an outlet for supplying a primary air-gas mixture and for providing an electrical ground potential to the burner cap assembly, a high voltage receptacle operatively associated with the spark electrode for providing an electrical high voltage potential to the spark electrode and support structure for securing the base assembly with the gas range and for accurately aligning and positioning the high voltage receptacle and the gas mixing member outlet with the burner cap assembly.

18 Claims, 5 Drawing Sheets

Fig. 9
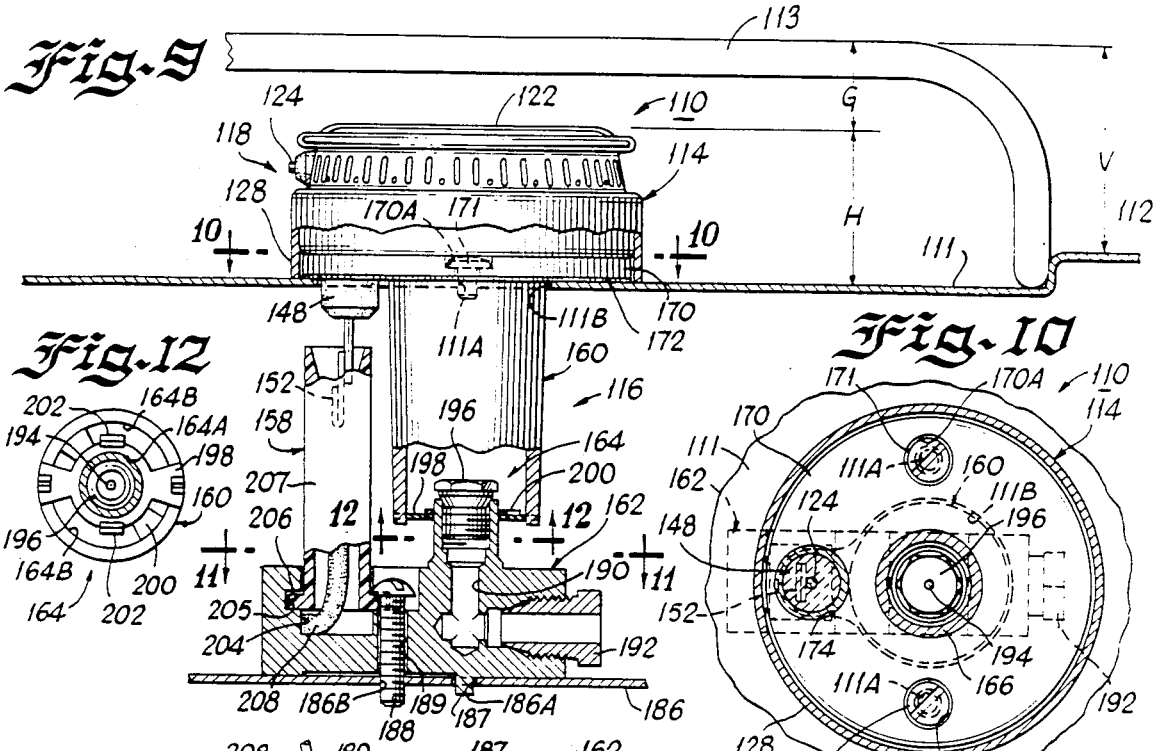
Fig. 12
Fig. 10
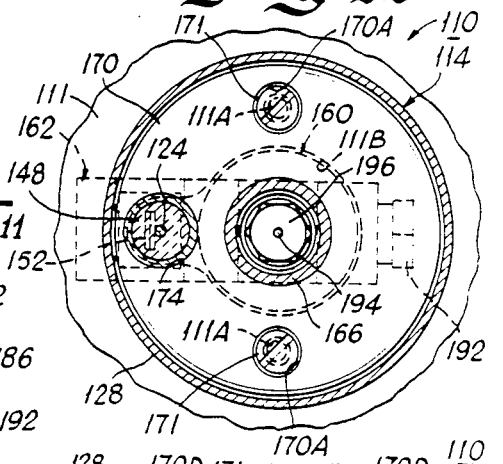
Fig. 11
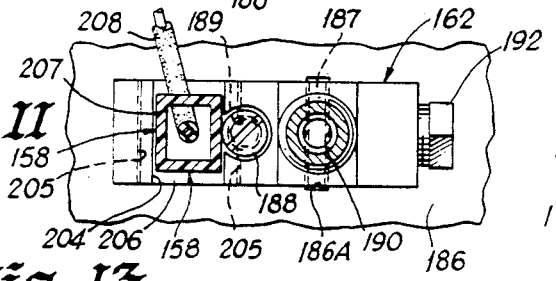
Fig. 15
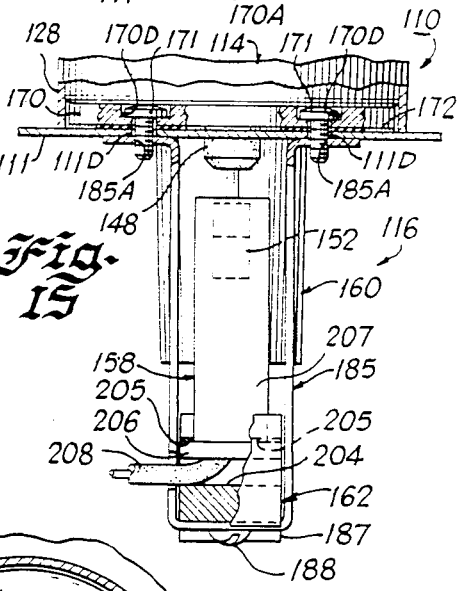
Fig. 13
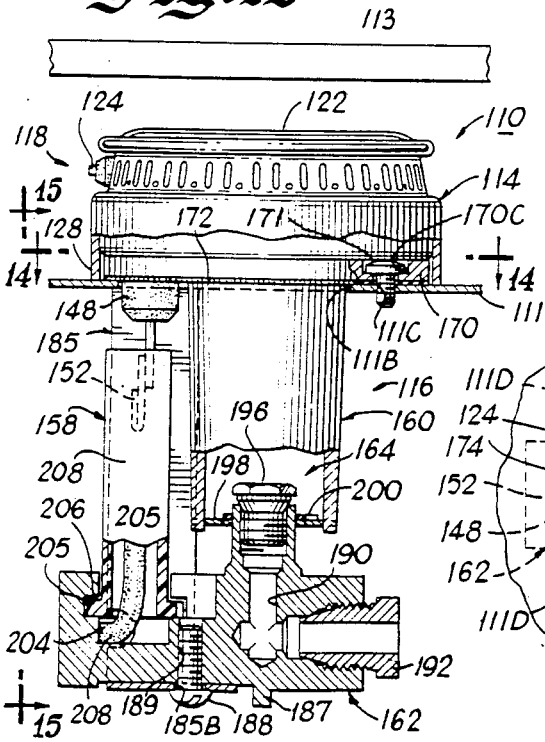
Fig. 14
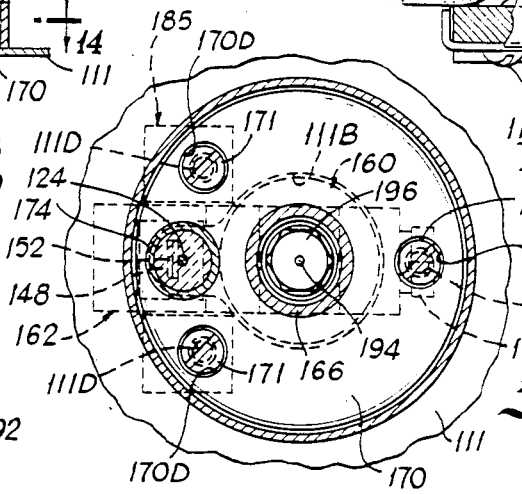

Fig. 16
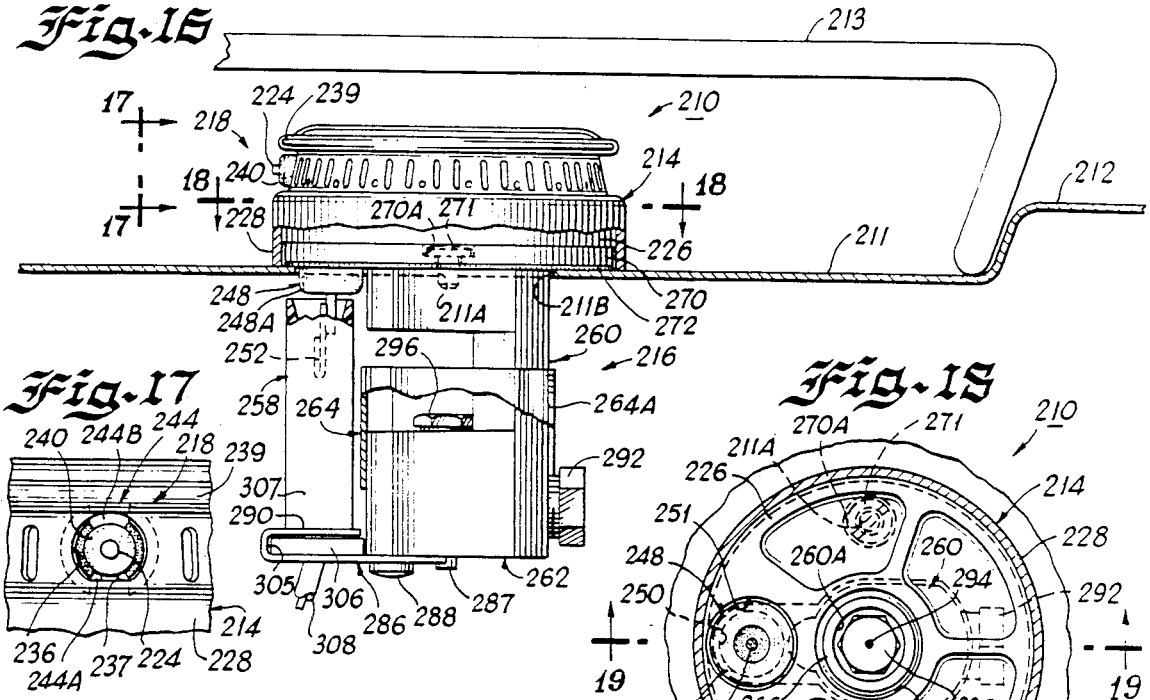
Fig. 17
Fig. 18
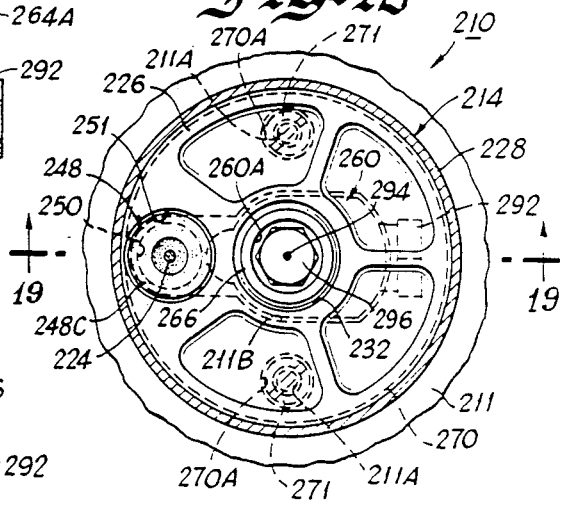
Fig. 20
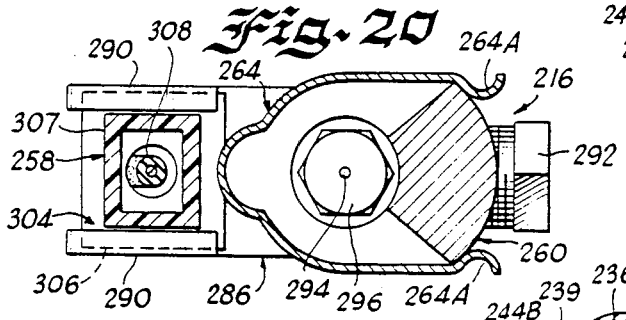
Fig. 21
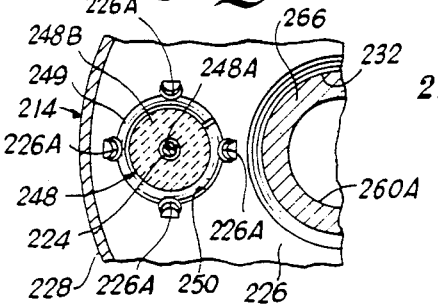
Fig. 19
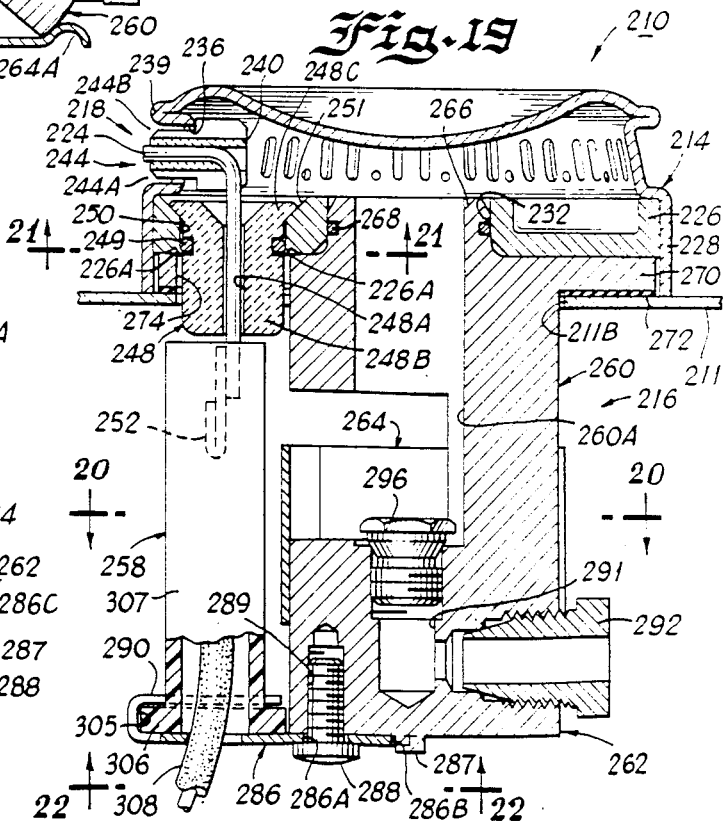
Fig. 22
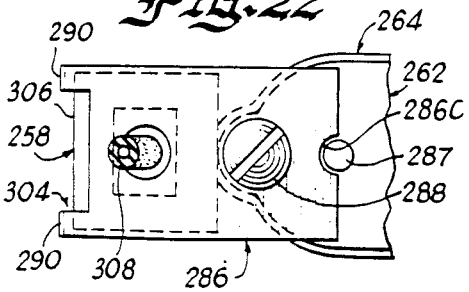

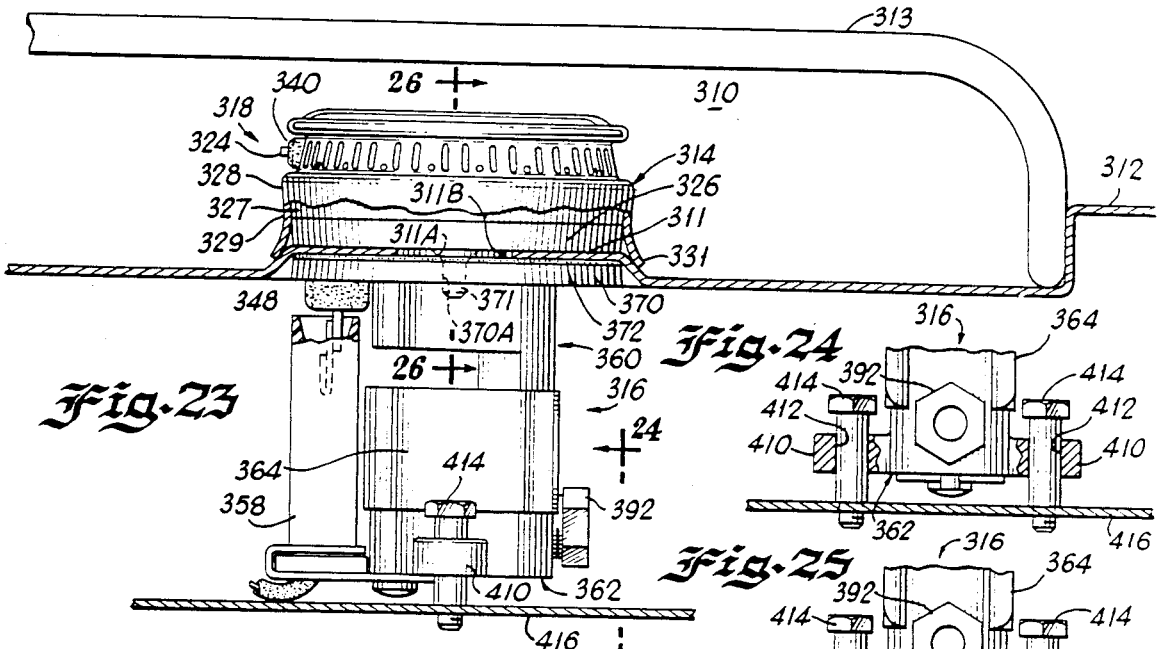
Fig. 23
Fig. 24
Fig. 25
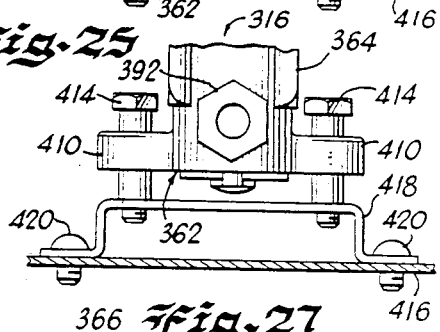
Fig. 26
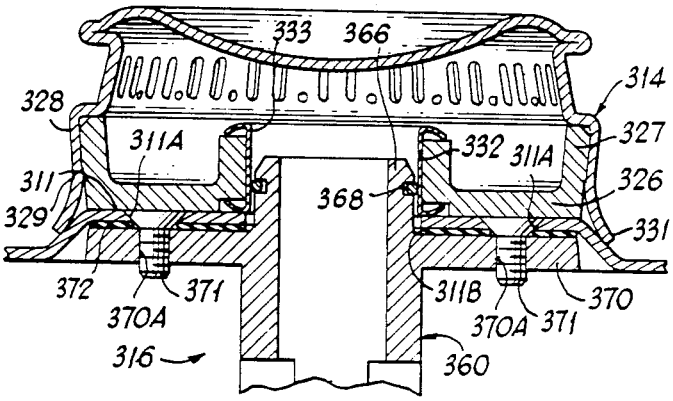
Fig. 27
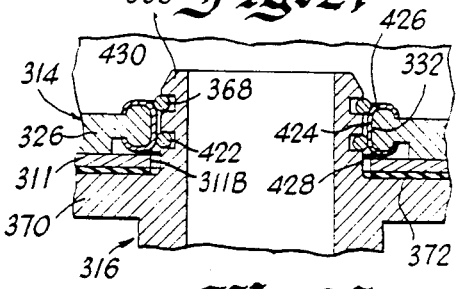
Fig. 28
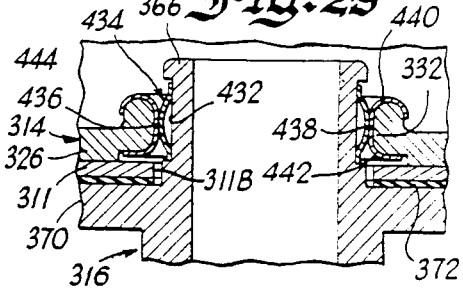
Fig. 29
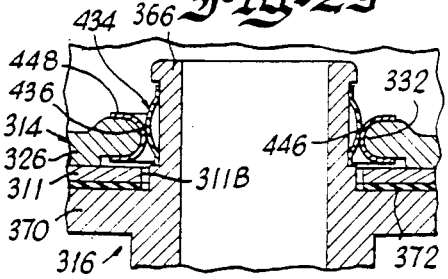
Fig. 30
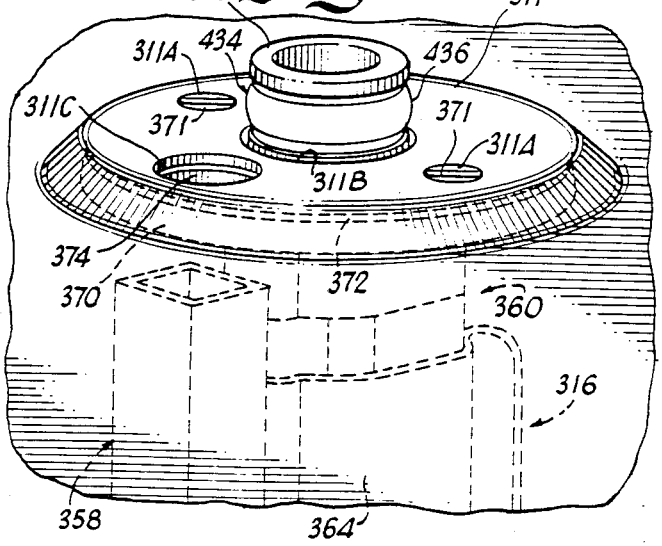

INTEGRAL SPARK IGNITED GAS BURNER ASSEMBLY

RELATED APPLICATION

The present application is a continuation-in-part of patent application Ser. No. 166,042, filed Mar. 9, 1988, now U.S. Pat. No. 4,810,188.

BACKGROUND OF THE INVENTION

The present invention relates to gas burners and more particularly to an improved integral spark ignition gas burner assembly.

Spark ignition is increasingly used because it avoids the energy consumption and heat caused by a standing igniter pilot flame that was often used in past to ignite gas burners such as gas range top burners.

U.S. Pat. No. 4,518,346 discloses a gas burner with a pair of electrodes for spark ignition inside the burner with a protective cap mounted on the burner body and orifices and grooves provided in an upper burner head part providing secondary air to permit ignition inside the burner. Disadvantages of this type of arrangement are the complexity of the assembly and unrelialibity in achieving ignition that may result from either low gas flow conditions or contamination within the secondary air grooves or orifices.

France Pat. No. 77 32910 discloses an electronic ignition gas burner with an electrode positioned directly within the primary air-gas fuel flow through a main burner port. With this type of ignition, reliable and repeatable operations may not be achieved due to the electrode position.

U.S. Pat. No. 4,626,196 discloses a spark ignited gas burner assembly including a burner body with an array of main burner ports, an electrically conductive burner top member and a spacer assembly to separate and electrically insulate the burner body and top member. An ignition gas pathway is defined between the burner body and the top member. A spark ignition circuit includes a spark gap in series circuit relationship between the burner body and the top member to provide ignition sparks in the ignition gas pathway. While this arrangement provides advantages over various known spark ignited burner assemblies, it is desirable to provide a burner assembly that enables repeatable and reliable ignition operations without using a separate top member electrically isolated from the burner body, that reduces the likelihood of electrical shock to the user, that is simple and inexpensive to make and to assemble, that includes a burner cap assembly which can be readily removed for cleaning, and that facilitates a more easily cleaned range configuration. Further it is desirable to provide such a burner assembly including a stationary base assembly to provide a simple and compact structure and with a gas range top surface configuration that provides optimum heat transfer and combustion operations.

SUMMARY OF THE INVENTION

Among the important objects of the invention are to provide an improved gas burner assembly for spark ignition; to provide a burner assembly making possible a simplified, less expensive and easily cleaned configuration; and to provide a burner assembly that overcomes many of the disadvantages of prior art burner assemblies.

In brief, in accordance with the above and other objects of the present invention, there is provided a gas burner assembly including a detachable burner cap assembly having an electrically conductive burner cap body with a plurality of burner ports and an ignition port formed in a sidewall of the burner cap body. The burner cap body is connected to an electrical ground potential. An electrically insulative support member is mounted in the ignition port and defines an electrode receiving aperture. The electrically insulative support member cooperates with the ignition port to define an ignition gas pathway. A spark electrode extending through the support member aperture includes a portion extending though the ignition port and completely surrounded by the insulative support member. The spark electrode is selectively connected to an high voltage potential for providing ignition sparks between the electrode and the burner body through the ignition gas pathway. A stationary base assembly is adapted for detachable mating engagement with the burner cap assembly. The stationary base assembly includes a member defining an aperature for receiving primary air and an outlet for supplying a primary air-gas mixture and for providing an electrical ground potential to the burner cap assembly, a high voltage receptacle operatively associated with the spark electrode for providing an electrical high voltage potential to the spark electrode and support structure for securing the base assembly with the gas range and for accurately aligning and positioning the high voltage receptacle and the gas mixing member outlet with the burner cap assembly.

BRIEF DESCRIPTION OF THE DRAWING

The present invention and its objects and advantages may be better understood from consideration of the following detailed description of the preferred embodiments of the invention illustrated in the accompanying drawings in which:

FIG. 9 is a side elevational view partially broken away to show interior details of an alternative burner assembly constructed in accordance with the invention with a gas range top and a cooking grate;

FIG. 10 is a sectional view taken along the line 10—10 of FIG. 9;

FIG. 11 is a sectional view taken along the line 11—11 of FIG. 9;

FIG. 12 is a sectional view taken along the line 12—12 of FIG. 9;

FIG. 13 is a side elevational view partially broken away to show interior details of the first alternative burner assembly of FIG. 9 as modified with a suspension mounting arrangement;

FIG. 14 is a sectional view taken along the line 14—14 of FIG. 13;

FIG. 15 is a sectional view taken along the line 15—15 of FIG. 13;

FIG. 16 is a side elevational view partially broken away to show interior details of a second alternative burner assembly constructed in accordance with the invention with portions of a gas range top and a cooking grate;

FIG. 17 is a sectional view taken along the line 17—17 of FIG. 16;

FIG. 18 is a sectional view taken along the line 18—18 of FIG. 16;

FIG. 19 is a sectional view taken along the line 19—19 of FIG. 18;

FIG. 20 is a sectional view taken along the line 17—17 of FIG. 19;

FIG. 21 is a sectional view taken along the line 21—21 of FIG. 19; and

FIG. 22 is a sectional view taken along the line 22—22 of FIG. 19;

FIG. 23 is a side elevational view partially broken away to show interior details of a third alternative burner assembly constructed in accordance with the invention with portions of a gas range top and a cooking grate;

FIG. 24 is a fragmentary sectional view taken along the line 24—24 of FIG. 23;

FIG. 25 is a fragmentary sectional view illustrating an alternative mounting arrangement of the burner assembly of FIG. 23; and FIG. 26 is a fragmentary sectional view taken along the line 26—26 of FIG. 23;

FIGS. 27, 28 and 29 are fragmentary sectional views similar to FIG. 26 showing further alternative connection arrangements of the burner assembly of FIG. 23; and FIG. 30 is a fragmentary perspective view illustrating a stationary base assembly of the third alternative burner assembly of FIG. 23.

DETAILED DESCRIPTION OF THE PREFERRED EMBODIMENTS

Figure 1:
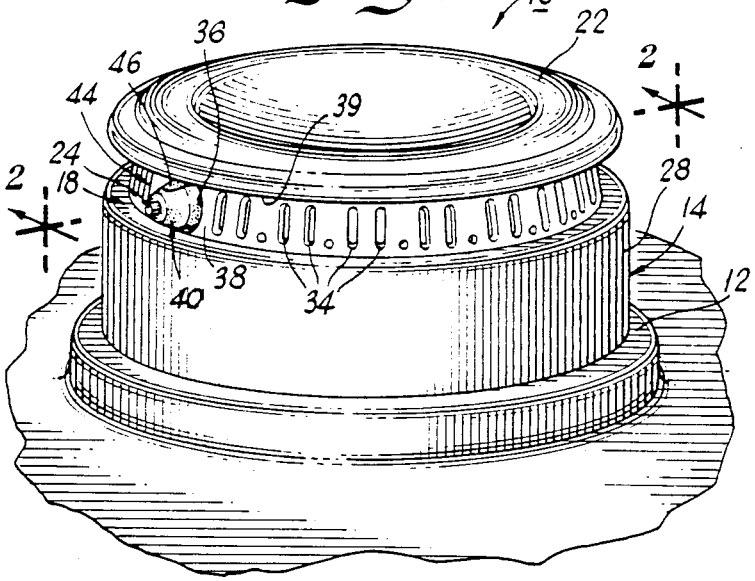
FIG. 1 is a perspective view of a portion of a range top including a burner assembly constructed in accordance with the invention.
Figure 2:
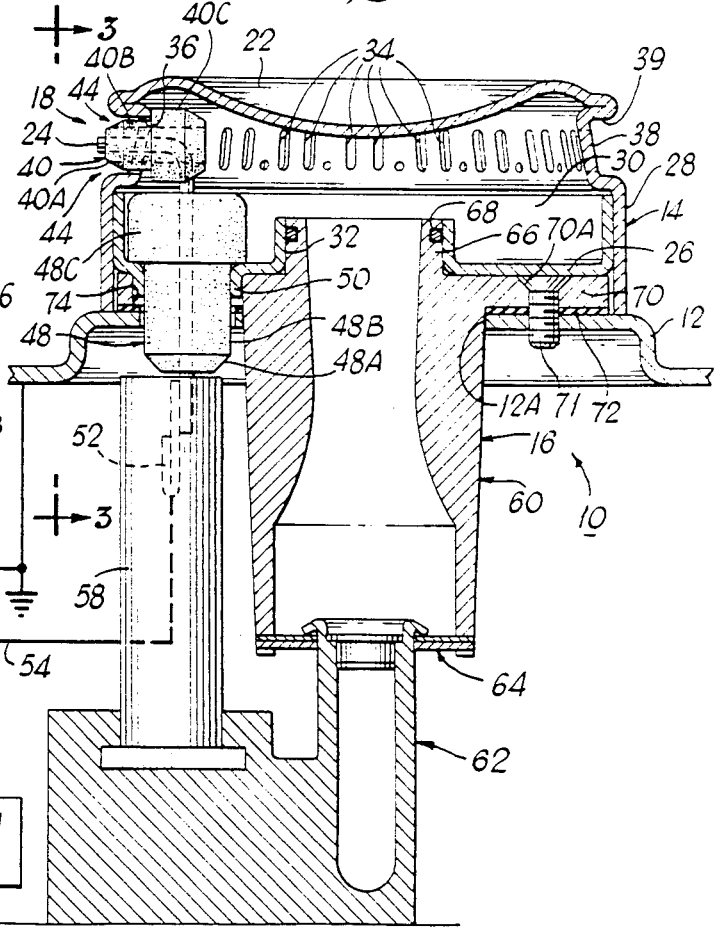
FIG. 2 is a partly schematic illustration of the burner assembly with a sectional view taken along the line 2—2 of FIG. 1.
Figure 6:
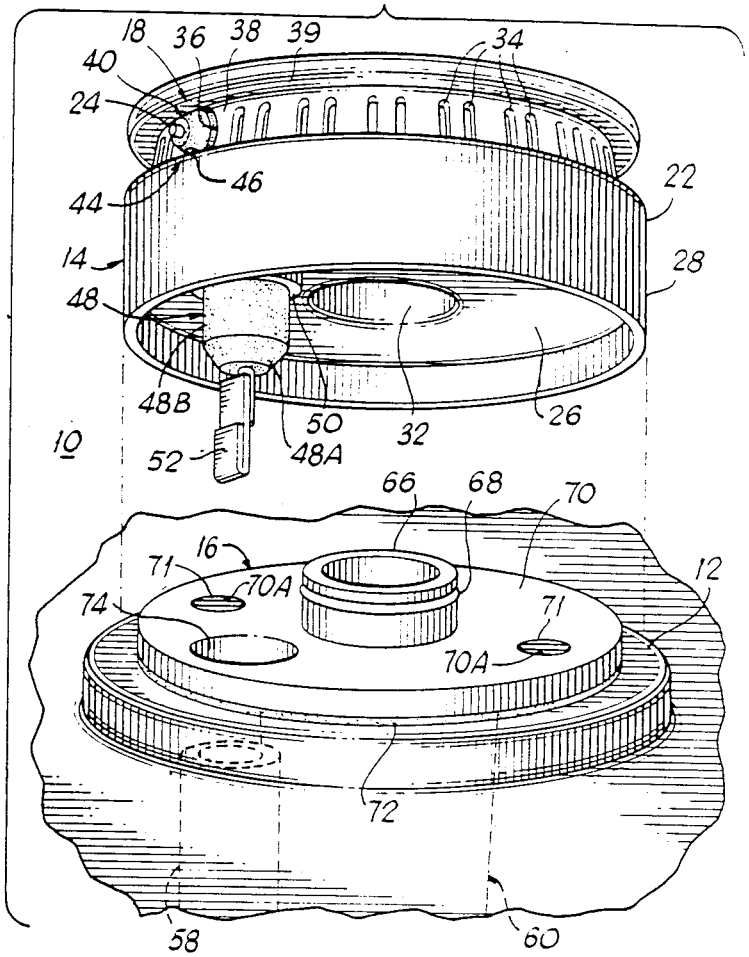
FIG. 6 is a perspective view of the burner cap assembly removed from a stationary base assembly of the burner assembly of FIG. 1.

Referring to FIGS. 1, 2, and 6, there is shown a gas burner assembly constructed in accordance with the principles of the present invention and designated as a whole by the reference numeral 10. A portion of a range top or cooking top 12 is shown with the burner assembly 10. The burner assembly 10 includes a detachable burner cap assembly designated as 14 and a stationary base assembly designated as 16. A spark electrode assembly designated as 18 is included with the burner cap assembly 14 for spark ignition.

An ignition circuit 20 provides an electrical ground potential to a burner cap 22 and selectively provides a high voltage potential to a spark electrode 24 of the cap assembly 14 causing ignition sparks to be produced. The ignition circuit 20 is under the control of a valve switch associated with a burner valve (not shown) that controls the fuel rates to the burner assembly 10 from an off condition to a wide range of gas flow rates. The electrode 24 functions as a flame sensing probe during normal burner operation of the burner assembly 10. The ignition circuit 20 may be generally of the character disclosed in the before mention U.S. Pat. No. 4,626,196, hereby incorporated by reference. It should be understood that other types of ignition circuits may be used to provide spark ignition at the burner assembly 10.

As its component parts, the burner cap assembly 14 includes the burner cap 22, a bottom plate 26 and the spark electrode assembly 18. The burner cap 22 and the bottom plate 26 are formed of electrically conductive material, such as stamped sheet metal of a #3003 aluminum alloy. The burner cap 22 and the bottom plate 26 are electrically connected with the range top 12 to electrical ground so that a separate ground connection and an insulative spacer member are not required.

In general, the detachable burner cap assembly 14 can be removed from the stationary base assembly 16, for example, for cleaning in an automatic dishwasher or in a self-cleaning oven. As described below, the burner cap assembly 14 is arranged as a modular unit to prevent disassembly of its component parts by the user so that problems resulting from possible misassembly or parts being displaced are avoided.

As shown in FIG. 2, the detachable burner cap assembly 14 includes the bottom plate 26 press fit or otherwise securely attached within a lower portion 28 of the a generally cylindrical burner cap body 22 defining a burner 5 fuel chamber 30. The bottom plate 26 includes a gas inlet 32 (FIG. 6) for supplying primary air-gas fuel mixture to the burner fuel chamber 30 from the stationary base assembly 16. Fuel flows from the chamber 30 through a plurality of main burner ports 34 and an ignition port 36 formed in a recessed portion 38 below a top wall 39 of the burner body 22. Secondary air for combustion at the ignition port 36 and the burner ports 34 flows from above the range top 12 rather than from an internal burner box location.

An electrically insulative support member designated as 40 of the spark electrode assembly 18 positions the spark electrode 24 for reliable and repeatable ignition throughout the entire range of gas flow rates for the burner assembly 10.

Figure 5:
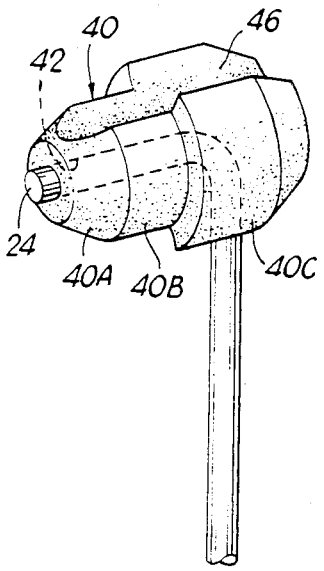
FIG. 5 is a perspective view illustrating a spark electrode assembly of the burner assembly of FIG. 1.

As best seen in FIG. 5, the insulative support member 40 has a centering tapered nose portion 40A, an intermediate body portion 40B slideably received within the ignition port 36 (FIGS. 1 and 2) and a rear body portion 40C positioning the nose portion 40A by providing a stop against the inside burner wall portion 38. The insulative support member 40 has a generally centrally disposed aperture 42 extending from the nose portion 40A to the rear body portion 40C for receiving the spark ignition electrode 24. The spark ignition electrode 24 is offset or L-shaped extending from the chamber 30 through the support member aperture 42 outside the burner body 22 and downwardly to the base assembly 16. Aperture 42 is similarly L-shaped to accommodate the spark ignition electrode 24.

Figure 3:
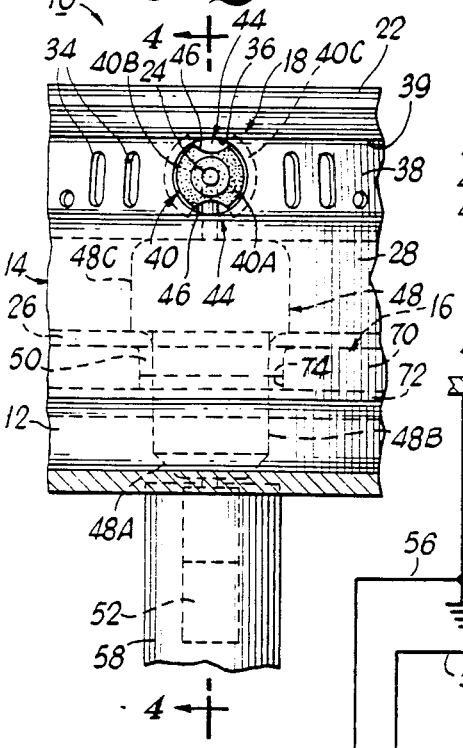
FIG. 3 is a fragmentary sectional view taken along the line 3—3 of FIG. 2.

An ignition gas region 44 is defined by the support member 40 in cooperation with the ignition port 36. Ignition port 36 is circular and has a diameter generally coinciding with the intermediate body portion 40B of the support member 40. As shown in FIGS. 3 and 5, a pair of generally U-shaped undercut grooves 46 are formed longitudinally along the outer periphery of the support member 40. When fuel is supplied to the burner assembly 10, ignition gas flows from chamber 30 through the grooves 46 to the ignition region 44 spaced between the spark electrode 24 and the burner top wall 39 and the burner body 28.

Figure 4:
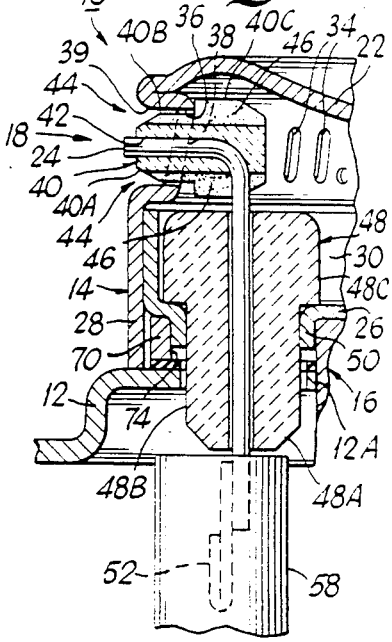
FIG. 4 is a fragmentary sectional view taken along the line 4—4 of FIG. 3.

As shown in FIGS. 2, 4, and 6, a second electrically insulative support member 48 of the spark electrode assembly 18 receives and isolates the electrode 24 from the burner body 22 and the bottom plate 26. The insulative support member 48 has a centering tapered nose portion 48A, an intermediate body portion 48B and an upper body portion 48C. The intermediate body portion 48B of the insulative support member 48 is press fit or otherwise securely attached within a generally circular sleeve 50 of the base plate 26 with the upper body portion 40C providing a stop against the base plate 26.

Insulative support members 40 and 48 are formed of an electrically insulating material, such as alumina or a composition ceramic material with a hard finish for cleanability. Spark ignition electrode 24 is an integral member formed of electrically conductive material, such as #310 stainless steel, having sufficient strength and stiffness needed to facilitate assembly of the burner cap 22 with the spark electrode assembly 18.

Assembly of the burner cap assembly 14 is simply provided by placing the first support member 40 with the spark electrode 24 positioned within its aperture 42 in the ignition port 36 and then attaching the base plate 26 with the second support member 48 secured within its sleeve 50 aligned for receiving the spark electrode 24. Then a terminal blade 52 is attached to the spark electrode 24 that in assembled relation extends within the stationary base assembly 16.

Electrical connection to the spark electrode 24 and the burner body 22 is made in any conventional fashion. In FIG. 2, a pair of conductors 54 and 56 are schematically shown from the ignition circuit 20 to provide the high voltage connection to the spark electrode 24 via the terminal blade 52 and the ground connection to the burner cap 22 through the range top 12.

As its major components, the stationary base assembly 16 includes a high voltage receptacle 58 and a venturi designated as 60. Venturi 60 is positioned around a gas inlet fitting 62 that is connected to an air shutter assembly 64 for supplying the mixture of gas and primary air to the burner cap assembly 14 through the venturi 60. Frictional interengagement of the burner cap assembly 14 is provided with the base assembly 16. Venturi 60 supplies primary air-gas mixture to the detachable burner cap assembly 14 through a centering projection 66 carrying a snap ring 68 clinched by the inlet 32 of the base plate 26 in assembled relation. As seen in FIG. 6, an upstanding flange or wall portion 70 includes a pair of apertures 70A. The flanged portion 70 is secured to the range top 12 by a pair of fasteners 71 received through the apertures 70A with one shown in FIG. 2. The fasteners 71 provide an effective electrical ground connection between the range top 12 and the venturi 60 and through the bottom plate 26 to the burner cap body 22. A gasket 72 is sandwiched between the flanged portion 70 and range top 12 to provide an effective liquid seal. In general outline, the flanged portion 70 is annular and has an outside diameter slightly smaller than the inside diameter of the burner cap 22. The insulative support member 48 is received through an opening 74 separated from the venturi gas supply 66 in the flanged portion 70.

As shown in FIG. 1, the burner assembly 10 makes possible a simple and easily cleaned range top or cooking top configuration. The stationary base assembly 16 is received in an opening 12A of the range top 12 bounded by the flanged portion 70 around which the burner cap 22 rests. The range top 12 is otherwise imperforate and includes no openings or spaces around the burner assembly 10 where contamination such as spillover from a cooking vessel can enter the region below the range top 12.

Figure 7:
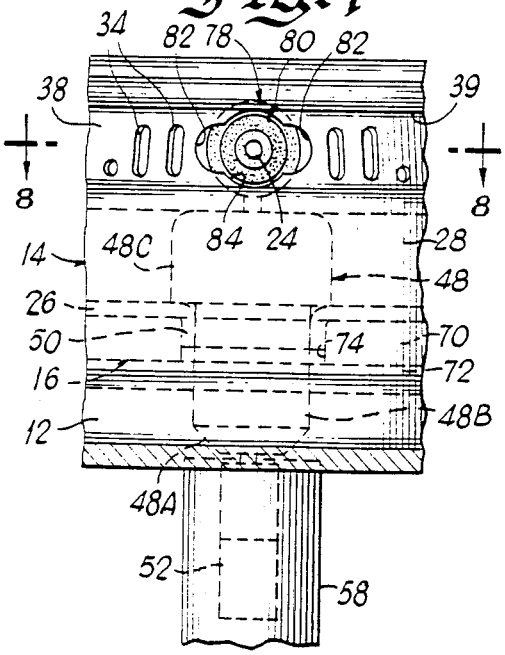
FIG. 7 is a fragmentary sectional view similar to FIG. 3 illustrating an alternative spark electrode assembly.
Figure 8:
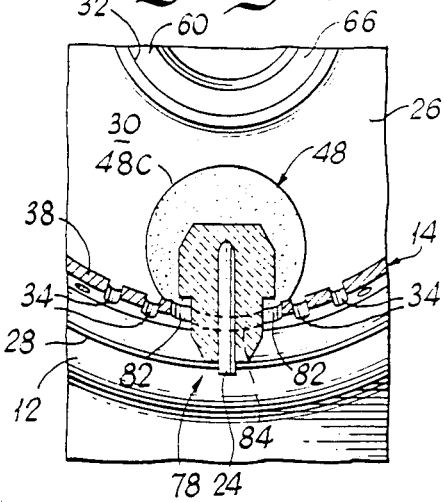
FIG. 8 is a fragmentary sectional view taken along the line 8—8 of FIG. 7.

Referring now to FIGS. 7 and 8, an alternative arrangement of a spark electrode assembly 78 is shown. In the alternative assembly 78, an insulative support member 80 is formed without channels such as the undercut grooves 46 in the insulative support member 40. Instead a pair of scallops 82 is configured in the periphery of the ignition port 84 to define the ignition gas pathway. While the scallops 82 are shown extending generally horizontally, vertically arranged cutouts may be preferable to define the ignition gas pathway between the electrode 24 and the walls 39 and 28 of the burner cap body 22. It should be understood that various other configured ignition ports and/or insulative support members could be employed to define the ignition gas pathway.

Referring now to FIGS. 9, 10, 11 and 12, there is shown a first alternative gas burner assembly constructed in accordance with the principles of the present invention and designated as a whole by the reference numeral 110. The burner assembly 110 includes a detachable burner cap assembly 114 including a spark electrode assembly 118 and a stationary base assembly designated as 116. The burner assembly 110 is shown mounted on a recessed planar portion 111 of a range top or cooking top 112 with an associated cooking grate 113.

Optimum heat transfer and combustion operations are facillated by providing a vent space V between the range top surface 112 and the top of grate 113 in a range between 1 and 1.35 inches and a grate space G between the burner cap top surface and the top of grate in a range between 0.6 and 0.7 inches. A depth of the recessed portion 111 is determined by the height H of the burner cap. For example, with a burner cap height H of 1.0 inch, the recessed portion has a depth of 0.25 inches to provide a vent space V of 1.35 inches and a grate space of 0.6 inches.

In the bas burner assembly 110, the detachable burner cap assembly 114 and the spark electrode assembly 118 are substantially similar to the burner cap assembly 14 and the spark electrode assembly 18. The recessed range top 111 is a planar surface eliminating the pedestal portion of the range top 12 as shown in FIGS. 1, 2 and 6.

As its major components, the stationary base assembly 116 includes a high voltage receptacle 158 operatively associated with a spark electrode 124 of the spark electrode assembly 118, a mixing or venturi tube 160 for supplying a primary air-gas fuel mixture to the burner cap assembly 114, a gas inlet support member designated as 162 for connection with a gas supply line and for supporting the base assembly 116 in a fixed position within the gas range and an air shutter assembly designated as 164 for entraining primary air in the venturi tube 160. The stationary base assembly 116 is adapted for accurately aligning and positioning the high voltage receptacle 158 and the gas mixing member 160 with the burner cap assembly 114.

An upstanding flange or wall portion 170 of the venturi 160 illustrated in FIGS. 9 and 10 is fixedly secured to the gas range top surface 111 by a pair of fasteners 171 received through a pair of recessed apertures 170A in the flange 170 and a corresponding pair of holes 111A in the top surface 111. An opening 111B is punched or formed in the range top surface 111 configured for receiving and positioning the venturi tube 160 and an insulative support member 148 surrounding the spark electrode 124. A lower body portion 128 of a burner cap body 122 overlies the flange 170 and a gasket 172 is sandwiched between the flange 170 and range top 111 configured for avoiding spillover from a cooking vessel entering the region below the range top. The insulative support member 148 is received through an opening 174 in the flange 170 separated from a venturi gas supply outlet 166.

As best seen in FIGS. 9 and 11, the gas inlet support member 162 is fixedly secured to a burner box bottom wall 186 that includes an elongated slot 186A for receiving a downwardly extending ledge portion 187 of member 162 and an aperture 186B for receiving a fastener 188 extending through an aligned aperture 189 in the support member 162. Slot 186A and hole 186B are punched or otherwise formed in the burner box bottom wall 186 accurately located relative to the openings 111A and 111B in the range top surface 111 for securing the base assembly 116 in fixed position with the gas range and the burner cap assembly 114 including the spark electrode assembly 118.

The gas inlet support member 162 includes a gas passageway 190 having a tapered inlet threaded to receive a fitting 192 which receives a gas supply conduit or tube (not shown) and terminates in an outlet orifice 194 of an orifice fitting 196 for supplying gas to the venturi tube 160.

Referring to FIG. 12, a central opening 164A is defined by a pair of shutter members 198 and 200 of the shutter assembly 164 for centering the outlet orifice 194 within the venturi tube 160. Shutter members 198 and 200 cooperate to define a plurality of air-receiving openings 164B around the inside circumference of the venturi tube 160. Shutter member 198 is fixedly secured to the venturi tube 160, such as by staking. Shutter member 200 is adjustably carried by the stationary shutter member 198 for controlling the openings 164B including a pair of opposed tab members 202 bent over the shutter member 198.

Referring again to FIGS. 9 and 11, the gas inlet support member 162 includes a channel 204 having a pair of opposed recessed slots 205 configured for receiving a radially extending rectangular flanged portion or ledge 206 formed at the lower end of an insulative body housing 207 of the high voltage receptacle 158. The high voltage receptacle 158 includes a conventional spring terminal (not shown) accurately positioned for mating engagement with a terminal blade 152 attached to the spark electrode 124. A high voltage/temperature conductor 208 coupled to the spark electrode 124 extends through the channel 204 for connection with the ignition circuit.

Referring now to FIGS. 13, 14 and 15, an alternative suspension mounting arrangement is shown for the gas burner assembly 110 eliminating the support engagement with the burner box bottom 186. A generally U-shaped strap support member 185 supports the stationary base assembly 116 in fixed position within the gas range for detachable mating engagement with the burner cap assembly 114. Support member 185 is a unitary member of metal, such as aluminum, stamped and formed to define the U-shape. As best seen in FIGS. 13 and 14, the upstanding flange 170 of the venturi 160 and the range top surface 111 are modified to include an additional aperature 170C and 111C for receiving a third fastener 171 and a pair of alternative apertures 170D and 111D replacing aperatures 170A and 111A for receiving fasteners 171 that are aligned with a pair of aperatures 185A defined in upper arm portions of the support member 185 extending adjacent and below the range top surface 111. An aperture 185B is defined in a lower bottom wall of the U-shaped support member 185 aligned with aperture 189 of the gas inlet support member 162 for receiving the fastener 188 inserted upwardly through the aligned apertures.

Referring now to FIGS. 16-22, there is shown a second alternative gas burner assembly in accordance with the present invention designated as 210 and mounted on a recessed planar portion 211 of a range top or cooking top 212 with an associated cooking grate 213. The burner assembly 210 includes a detachable burner cap assembly designated as 214 including a spark electrode assembly designated as 218 and a preferred stationary base assembly designated as 216. In the gas burner assembly 210, a bottom plate member 226 is configured to provide a reduced height for the detachable burner cap assembly 214. A separate venturi member such as venturi 60 of FIGS. 1-8 or venturi 160 of FIGS. 9-15 has been eliminated in the preferred stationary base assembly 216 by an integrally formed upper venturi or gas mixing portion 260 of a gas inlet support member 262. Accurate positioning of a high voltage receptacle 258 is provided by a clip bracket 286 secured to the gas inlet support member 262.

Referring first to FIG. 17, an alternative, preferred spark electrode assembly 218 including a generally D-shaped ignition port 236 and a first support member 240 surrounding a spark electrode 224. A flat wall portion 237 of the ignition port 236 is located proximate to a burner body 228. An ignition gas region 244 is defined by support member 240 in cooperation with the ignition port 236 spaced between the spark electrode 224 and a burner top wall 239 and a burner body sidewall 228. A lower ignition gas pathway portion 244A is smaller than an upper ignition gas pathway portion 244B and provides improved flame sensing operation with the centrally disposed spark electrode 224.

As best seen in FIGS. 18 and 19, a bottom plate 226 of the burner cap assembly 214 includes a centrally disposed gas inlet 232 for receiving a primary air-gas supply. A second insulative support member 248 carrying a snap ring 249 is clinched within an opening 250 in the bottom plate 226 spaced apart from the gas inlet 232. A central passageway 248A in the second insulative support member 248 receives the spark electrode 224. The second insulative support member 248 includes a main body portion 248B and an enlarged upper body portion 248C seated within a tapered entrance 251 of the bottom plate opening 250. As illustrated best seen in FIG. 21, the insulative support member 248 is accurately positioned within aperature 250 and then is fixedly secured to the bottom plate 226, such as by staking at a plurality of locations 226A on the lower surface of the bottom plate 226. A terminal blade 252 attached to the spark electrode 224 is thereby maintained accurately positioned below the range top 211 in the burner assembly 210.

An air receiving opening 260A is defined laterally in the venturi portion 260 for receiving primary air. An air shutter member 264 is axially slidably disposed around the venturi portion 260 for adjusting the opening 260A. The air shutter member 264 is a unitary member stamped and formed of metal, such as aluminum, configured generally corresponding to the shape of the venturi portion 260. A pair of spring portions 264A near the opposite ends of the shutter member 264 frictionally secure the shutter member 264 with the venturi portion 260.

Primary air-gas is supplied to the burner cap assembly 214 through an upper, circular projection 266 of the integrally formed venturi portion 260 extending above an upstanding flanged portion 270 of the gas inlet support member 262. Centering projection 266 carries a snap ring 268 clinced by the inlet 232 providing mechanical and electrical ground connection with the burner cap assembly 214. The upstanding flanged portion 270 includes a pair of recessed apertures 270A for receiving a pair of fasteners 271 and an aperature 274 aligned with base plate aperature 250 for receiving the second insulative support member 248. Referring to FIG. 18, the recessed range top portion 211 includes a pair of aperatures 211A aligned with the flange apertures 270A and an elongated aperture 211B shaped for receiving the upper, generally rectangular venturi portion 260 and the generally circular main body portion 248B of the insulative support member 248.

Referring to FIGS. 18, 19, 20 and 22, the clip bracket 286 is secured to the gas inlet support member 262 by a fastener 288 received upwardly through an aperture 286A in the clip bracket 286 and an aligned aperture 289 in the support member 262. A downwardly depending protuberance 287 of the support member 262 is received in a corresponding notch 286B within the bracket 286 for accurately aligning the high voltage receptacle 258. The clip bracket 286 includes a pair of legs 290 spaced apart to define a passageway 304 for receiving an insulative body housing 307 of the high voltage receptacle 258. The spaced apart legs 290 are formed to define a channel 305 configured for receiving a radially extending rectangular ledge portion 306 formed at the lower end of the housing 307 and accurately positioning a conventional spring terminal (not shown) contained in the housing 307 for mating engagement with the terminal blade 252. A high voltage/temperature conductor 308 extends between the lower portion of legs 290 for connection with the ignition circuit. The gas inlet support member 262 includes a gas passageway 291 having a tapered inlet threaded to receive a gas supply fitting 292 and terminates in an outlet orifice 294 of an orifice fitting 296 for supplying gas to the venturi mixing portion 260.

Both the air shutter member 264 and the clip bracket 286 can be stamped and formed of metal, such as aluminum. The gas inlet support member 262 preferably is formed by metal casting, such as of #380 aluminum.

Referring now to FIG. 23, there is shown a third alternative gas burner assembly in accordance with the present invention designated as 310 mounted on a recessed pedestal portion 311 of a range top or cooking top 312 with an associated cooking grate 313. The burner assembly 310 includes a detachable burner cap assembly designated as 314 including a spark electrode assembly designated as 318 and a stationary base assembly designated as 316. In the burner assembly 310, the burner cap assembly 314 and the base assembly 316 are modified to facillitate removal of the cooking top 312 to provide access to the base assembly 316 for repair or adjustment.

Referring also to FIG. 24, a gas inlet support member 362 of the stationary base assembly 316 is similar to the support member 262 of of FIGS. 16–22 modified to include a pair of opposed ears 410, each defining an aperture 412 for receiving a fastener 414, such as a shoulder screw for securing the support member 362 to a gas burner box bottom 416. Shoulder screws 414 facillate use of a standard sized support member 362 for various spaced dimensions of the burner box bottom 416 below the pedestal potion 311.

Referring to FIG. 25, an alternative mounting arrangement for the stationary base assembly 316 is shown to accommodate for larger spaced dimensions between the burner box bottom 412 and the pedestal portion 311 further including a mounting bracket 418 secured to the support member 362 and a pair of fasteners 420 for securing the bracket 418 with the burner box bottom 416.

Burner cap assembly 314 is illustrated in more detail with a gas outlet 366 of the stationary base assembly 316 in FIG. 26. A base plate 326 includes an outside wall or peripheral plate edge having an indexed or stepped shoulder 327 for frictional engagement with a corresponding deformed portion 329 of the burner cap body 328 adapted for maintaining firm frictional engagement of the base plate 326 and the burner cap body 328 substantially unaffected by thermal cycling of the burner assembly 310. A tapered lower portion 331 of the generally cylindrical burner cap body 328 overlies an upper part of the pedestal range top surface portion 311.

An upstanding flanged portion 370 of a venturi tube portion 360 is positioned inside the pedestal range top surface portion 311 with a gasket 372 sandwiched between the flange 370 and the bottom surface of pedestal portion 311. A pair of tapered apertures 31!A defined in the pedestal range top surface portion 311 are aligned with a pair of aperatures 370A in the flange 370 for receiving a pair of fasteners 371.

A centrally located primary air-gas receiving inlet 332 of the base plate 326 includes an eyelet or ring member 333 for receiving a venturi outlet projection 366 carrying a snap ring 368. Ring member 333 and the snap ring 368 are clinced between the venturi outlet projection 366 and the base plate inlet 332. Ring member 333 is formed of metal, such as stainless steel or a nickel brass alloy to avoid corrosive interaction between the projection 366 carrying the snap ring 368 is received through a centrally located range top aperture 311B.

As shown in FIG. 30, an insulative support member 348 surrounding a spark electrode 324 of the spark ignition assembly 318 is received through a range top aperature 311C spaced from the range top aperature 311B and an aligned aperture 374 in the base plate 326.

FIGS. 27, 28 and 29 are fragmentary sectional views similar to FIG. 26 illustrating alternative connection arrangements between the burner cap assembly 314 and the stationary base assembly 316 of the burner assembly 310. Referring first to FIG. 27, the venturi outlet projection 366 carrying a snap ring 368 is modified for carrying a second snap ring 422 axially spaced below the snap ring 368. The inlet 332 of base plate 326 includes a sidewall 424 having a upper wall portion or shoulder 426 and a lower wall portion or shoulder 428 carrying a correspondingly shaped eyelet 430. Frictional interengagement between the burner cap assembly 314 and the stationary base assembly 316 is provided with the shoulders 426 and 428 positioned relative to the snap rings 368 and 422, as shown.

Referring to FIGS. 28, 29 and 30, a venturi outlet projection 366 includes a recessed portion 432 for carrying a ring member 434. Ring member 434 is formed of metal, such as stainless steel or a nickel brass alloy to avoid corrosive interaction between the projection 366 and the base plate inlet 332. Ring member 434 is formed with a toroidal surface designated as 436 for frictional engagement with the inlet 332 of base plate 326. In FIG. 28, the base plate inlet 332 includes a flat sidewall 438 defined between a upper toroidal surface 440 and a lower toroidal surface 442 carrying a correspondingly shaped eyelet 444. The toroidal surface 436 of ring member 434 engages the flat sidewall 438. In FIG. 29, the base plate inlet 332 is defined by a toroidal surface 446 carrying a correspondingly shaped eyelet 448 urged downwardly by the toroidal surface 436 of ring member 434.

Although the present invention has been described in connection with details of the preferred embodiments, many alterations and modifications may be made without departing from the invention. Accordingly, it is intended that all such alterations and modifications be considered as within the spirit and scope of the invention as defined in the appended claims.

What is claimed and desired to be secured by Letters Patent is:

1. A gas burner assembly comprising:

a detachable burner cap assembly including an electrically conductive burner cap body including a sidewall, a plurality of burner ports and an ignition port formed in said burner body sidewall and gas inlet means for receiving primary air-gas fuel mixture;

an electrically insulative support member extending through said ignition port having an electrode receiving aperture, said support member and said ignition port cooperating to define an ignition gas pathway; and a spark electrode extending through said support member aperture and including a portion extending though the ignition port surrounded by said insulative support member; and a stationary base assembly including an air-gas mixing member defining an aperature for receiving primary air and outlet means for supplying a primary air-gas mixture and for providing an electrical ground potential to the burner cap assembly;

a high voltage receptacle operatively associated with said spark electrode for providing an electrical high voltage potential to said spark electrode; and support means for securing said base assembly with the gas range.

2. A gas burner assembly as recited in claim 1 wherein said gas inlet means for receiving primary air-gas fuel mixture includes a bottom plate member received within said burner cap body, said bottom plate having an opening for receiving primary air-gas fuel mixture and an electrically conductive sleeve member mounted in said opening.

3. A gas burner assembly as recited in claim 2 wherein said bottom plate member has a generally circular peripheral plate edge, said peripheral plate edge having a stepped shoulder for engagement with said burner cap body sidewall.

4. A gas burner assembly as recited in claim 2 wherein said bottom member opening is generally circular and said gas mixing member outlet means include an upstanding tubular portion received in said bottom member opening and spring means carried by said tubular portion for engagement with said electrically conductive sleeve member.

5. A gas burner assembly as recited in claim 4 wherein said spring means include a pair of axially spaced apart snap rings.

6. A gas burner assembly as recited in claim 4 wherein said bottom member opening has a generally flat sidewall defined between upper and lower toroidal surfaces, said sleeve member shaped conforming to said opening and said spring means include a ring member having a toroidal surface for engagement with said opening sidewall.

7. A gas burner assembly as recited in claim 2 wherein said bottom member opening has a sidewall defined by a generally toroidal surface, said sleeve member shaped conforming to said opening and said spring means include a ring member having a toroidal surface for engagement with said opening sidewall.

8. A gas burner assembly as recited in claim 4 wherein said bottom plate member and said burner cap body are formed of aluminum and said electrically conductive sleeve member is formed of a metal other than aluminum.

9. A gas burner assembly as recited in claim 8 wherein said spring means include a ring member having a toroidal surface and said ring member is formed of a metal other than aluminum.

10. A gas burner assembly as recited in claim 1 wherein said air-gas mixing member includes a lower tubular end portion for receiving a gas supply and for defining said primary air receiving aperature and further comprising shutter means secured to said lower tubular end portion for adjustably controlling said primary air receiving aperature.

11. A gas burner assembly as recited in claim 1 wherein said air-gas mixing member is an integrally formed upper air-gas mixing body portion of a unitary body having an inlet for receiving a gas supply and having a gas outlet for supplying gas to said upper air-gas mixing body portion, said primary air receiving aperature is defined laterally in said upper air-gas mixing body portion.

12. A gas burner assembly as recited in claim 11 further comprising shutter means operatively associated with said primary air receiving aperature.

13. A gas burner assembly as recited in claim 12 wherein said shutter means is axially slidably disposed around said upper air-gas mixing body portion for adjusting said laterally defined air receiving aperture.

14. A gas burner assembly as recited in claim 1 wherein said support means for securing said base assembly with the gas range include an upstanding flanged integrally formed portion of said air-gas mixing member.

15. A gas burner assembly as recited in claim 11 wherein said support means for securing said base assembly with the gas range include an upstanding flanged portion of said air-gas mixing body portion for securing said unitary body with a gas range top surface.

16. A gas burner assembly as recited in claim 15 further comprising a support member secured to said unitary body for positioning said high voltage receptacle with said burner cap assembly.

17. A gas burner assembly as recited in claim 15 wherein said support means further include means for securing said unitary body with a gas range burner box bottom surface.

18. A gas burner assembly comprising in combination a detachable burner cap assembly and a stationary base assembly:

the detachable burner cap assembly including an electrically conductive burner cap body including a sidewall, a plurality of burner ports and an ignition port formed in said burner body sidewall;

a bottom plate secured within said burner cap body defining gas inlet means for receiving primary air-gas fuel mixture;

an electrically insulative support member extending through said ignition port having an electrode receiving aperture, said support member and said ignition port cooperating to define an ignition gas pathway; and a spark electrode extending through said support member aperture and including a portion extending though the ignition port completely surrounded by the insulative support member; and the stationary base assembly including a unitary body having an upper air-gas mixing portion defining an aperature for receiving primary air, outlet means for supplying a primary air-gas mixture and for providing an electrical ground potential to the burner cap assembly and support means for securing said base assembly with the gas range; and a high voltage receptacle operatively associated with said spark electrode for providing an electrical high voltage potential to said spark electrode.

* * * * *

UNITED STATES PATENT AND TRADEMARK OFFICE

CERTIFICATE OF CORRECTION

PATENT NO. : 4,846,671

DATED : July 11, 1989

INVENTOR(S) : David J. Kwiatek

It is certified that error appears in the above-identified patent and that said Letters Patent is hereby corrected as shown below:

IN THE ABSTRACT:

Line 12, change "though" to --through--.
Line 14, change "an" to --a--.

IN THE SPECIFICATION:

Column 2, line 14, change "though" to --through--.
Column 2, line 16, change "an" to --a--.
Column 2, line 22, change "aperature" to --aperture--.
Column 4, line 26, delete the word "a".
Column 8, line 2, change "aperatures" to --apertures--.

Column 8, line 4, change "aperatures" to --apertures--.

Column 8, line 56, change "aperature" to --aperture--.

Column 9, line 15, change "aperature" to --aperture--.

Column 9, line 16, change "aperature" to --aperture--.

Column 9, line 19, change "aperatures" to --apertures--.

UNITED STATES PATENT AND TRADEMARK OFFICE

CERTIFICATE OF CORRECTION

PATENT NO. : 4,846,671

DATED : July 11, 1989

INVENTOR(S) : David J. Kwiatek

It is certified that error appears in the above-identified patent and that said Letters Patent is hereby corrected as shown below:

Column 10, line 32, change number-character-letter combination "31!A" to --311A--.

Column 10, line 49, change "aperature" to --aperture--.

Column 10, line 50, change "aperature" to --aperture--.

Column 11, line 40, change "though" to --through--.

Column 11, line 43, change "aperature" to --aperture--.

Column 12, line 32, change "aperature" to --aperture--.

Column 12, line 35, change "aperature" to --aperture--.

Column 12, line 42, change "aperature" to --aperture--.

Column 12, line 46, change "aperature" to --aperture--.

Column 14, line 7, change "aperature" to --aperture--.

Signed and Sealed this

Twelfth Day of November, 1991

*Attest:*

*Attesting Officer*

HARRY F. MANBECK, JR.

*Commissioner of Patents and Trademarks*